US005089673A

United States Patent [19]

Strzodka

[11] Patent Number: 5,089,673

[45] Date of Patent: Feb. 18, 1992

[54] PRESSURE OPERATED ELECTRICAL SWITCHING DEVICE WITH PLURAL LEVER ACTUATED MICROSWITCHES

[75] Inventor: Hubert Strzodka, Friedberg, Fed. Rep. of Germany

[73] Assignee: Imo Industries, GmbH, Reichelsheim, Fed. Rep. of Germany

[21] Appl. No.: 501,285

[22] Filed: Mar. 30, 1990

[30] Foreign Application Priority Data

Apr. 4, 1989 [DE] Fed. Rep. of Germany ..... 3910837

[51] Int. Cl.[5] ..... H01H 35/38

[52] U.S. Cl. ..... 200/82 C; 200/81.4

[58] Field of Search ..... 200/81 R, 81.4, 81.8, 200/82 R, 82 A, 82 C

[56] References Cited

U.S. PATENT DOCUMENTS

| | | | |
|---|---|---|---|
| 2,268,340 | 12/1941 | Loomis | 200/82 C |
| 2,895,024 | 7/1959 | Brown et al. | 200/82 C |
| 4,493,957 | 1/1985 | Watters | 200/81 R |
| 4,827,093 | 5/1989 | Strzodka | 200/82 C |

FOREIGN PATENT DOCUMENTS

| | | |
|---|---|---|
| 2243673 | 3/1973 | Fed. Rep. of Germany . |
| 2905792 | 6/1980 | Fed. Rep. of Germany . |
| 3605388 | 8/1987 | Fed. Rep. of Germany . |
| 3704718 | 8/1987 | Fed. Rep. of Germany . |
| 3627695 | 2/1988 | Fed. Rep. of Germany . |
| 882291 | 5/1943 | France . |

*Primary Examiner*—J. R. Scott

*Attorney, Agent, or Firm*—Wegner, Cantor, Mueller & Player

[57] ABSTRACT

An electrical switching device includes a switch plunger which is axially displaceable within a housing and two opposing radially directed rocking levers each disposed on a sharp edge formed on the housing. When pressure is applied to the switch plunger, the rocking levers are caused to rotate about the sharp edges and thus each actuate an associated microswitch. The transformation ratio between the stroke of the switch plunger and the stroke of the switch pen of each microswitch can be adjusted by movement of the microswitch with respect to the associated rocking lever.

8 Claims, 1 Drawing Sheet

PRESSURE OPERATED ELECTRICAL SWITCHING DEVICE WITH PLURAL LEVER ACTUATED MICROSWITCHES

BACKGROUND OF THE INVENTION

The invention relates to an electrical switching device with an axially displaceable switch plunger against which is braced a rocking lever which is swingable about a sharp edge fixed in the housing and is formed for actuation of a microswitch. Such a switching device is the object of U.S. Pat. No. 2,268,340.

The known switching device has a relatively large size. It has only a single rocking lever and only one microswitch actuated thereby. However, for many applications it is necessary that two microswitches be actuated by one switch plunger at different pressures. The switch plunger must then be braced against a total of two rocking levers. If the known switching device were to be supplemented by a second rocking lever and microswitch, then it would take up an undesirably large amount of space for many applications.

SUMMARY OF THE INVENTION

The underlying problem addressed by the invention is to design a switching device of the initially mentioned type so that it is as compact as possible and so that two microswitches are actuatable with it at different pressures.

This problem is solved according to the invention in that two rocking levers lying opposite one another symmetrically with respect to the switch plunger are disposed on a housing top part having two sharp edges, each rocking lever being braced against the switch plunger with its lever arm that faces toward the switch plunger and pressing against a microswitch with its other lever arm.

This design results in an especially compact switching device with two microswitches that are actuatable at different pressures. The compact construction has the simultaneous result that the microswitch is very sturdy and operates independently of vibrations. It is especially suitable, for example, for use in motor vehicles in conjunction with antilocking systems.

One preferred embodiment of the switching device has an especially simple construction in that the housing top part consists of a base plate having the previously-mentioned sharp edges and a support bridge which is directed parallel to the sharp edges and on whose side faces the two microswitches are disposed.

Microswitches are designed so that the switching point is higher during a pressure buildup than during a pressure drop, since, in the event of a pressure buildup and subsequent pressure drop, after it reaches the switching point the switch pin must traverse a different path before it reaches the so-called switch-back point. The mutual distance between the two switching points of the microswitches can be changed in a simple manner by changing the transformation ratio if, according to an advantageous refinement of the invention, the microswitches each have a switch lever running in the direction of the respective sharp edge with which they press against the rocking lever, and if the microswitches are each held on the support bridge displaceably in the longitudinal direction of the sharp edge.

The displaceability of the microswitches is especially simple to achieve if in each of two holes in the support bridge directed parallel to the sharp edges there is disposed a slide piece, each of which holds a microswitch.

The region of the switching points can be displaced upward or downward as a whole, if each of the rocking levers is braced on the switch plunger with an adjustable adjusting screw.

The manufacturing costs of the switching device are reduced if the housing top part is connected to the rest of the housing by flanges extending over the edge of the rest of the housing.

The switching device is especially compact and sturdy if each rocking lever is formed as a semicircular disk, as seen in top view, whose straight edge partially covers the switch plunger, and if on both sides of the switch plunger a guide screw extends into the base plate through a cutout in the rocking lever, so that the screw head is braced against a spring which presses with its other end against the rocking lever.

An overstressing of the rocking lever and microswitch can be avoided in a simple manner by having the switch plunger, on the side facing away from the rocking lever, extend via a switch extension into a housing-fixed stop plate into which a pressure-loaded piston is guided from the other side. Thus, the maximum possible displaceability of the piston is limited by a shoulder of the stop plate.

BRIEF DESCRIPTION OF THE DRAWINGS

The invention permits numerous possible embodiments. One of them is illustrated in the drawing and is described below. In the drawing.

DETAILED

Figure 1:
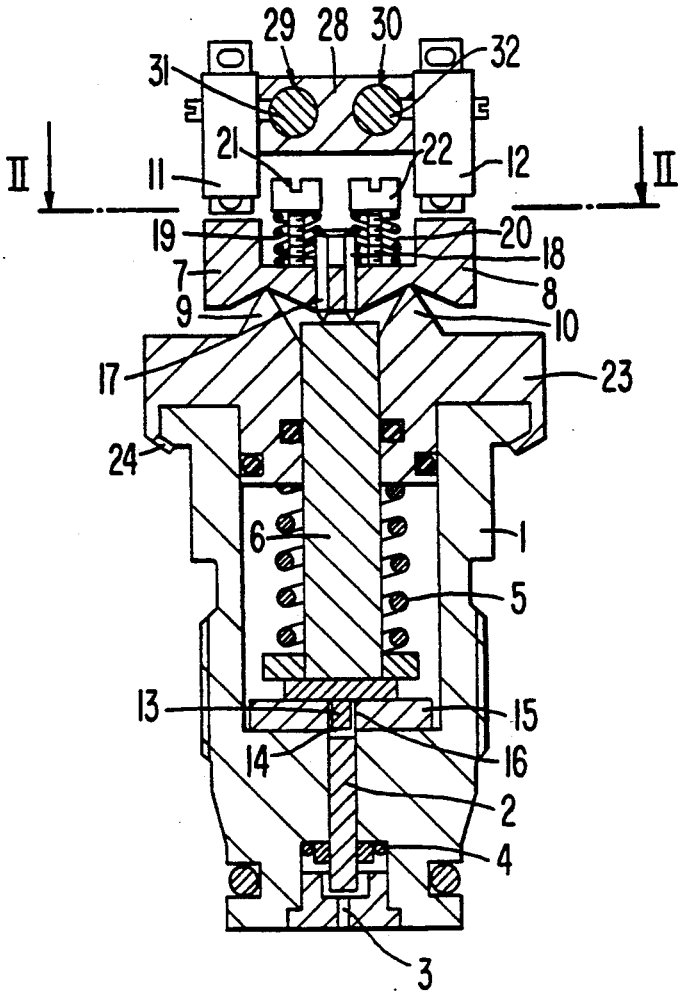
FIG. 1 shows a partial longitudinal section through a switching device according to the invention.

The electrical switching device illustrated in its entirety in FIG. 1 has, disposed in a housing 1, an axially displaceable piston 2 whose lower end face is to be loaded by pressure via a housing hole 3. The piston 2 is sealed from the housing 1 by a seal 4. When the piston 2 is loaded by pressure, it moves into the housing 1 and displaces a switch plunger 6 against the force of a switch spring 5. This switch plunger 6 enables two rocking levers 7, 8 to swing or pivot, each of which is held pivotably on a sharp edge 9, 10. The rocking levers 7, 8 each enable a microswitch 11, 12 (not shown in cross-section) to actuate.

In order to preclude an overloading of the rocking levers 7, 8 and microswitches 11, 12 at an extreme high pressure, the switch plunger 6 extends via a switch extension 13 into a graduated hole 14 in a stop plate 15 which is firmly connected to the housing 1, so as to grip the stop plate. The diameter of the hole 14 in the stop plate 15 widens downwardly, so that, as the switch extension 13 and therewith the switch plunger 6 are displaced, the piston 2 can move into it until it arrives against a shoulder 16 in the hole 14 and thus against a stop.

Each of the two rocking levers 7, 8 is braced against the upper end face of the switch plunger 6 by an adjusting screw 17, 18 screwed into it. They are biased toward the switch plunger 6 by springs 19, 20, disposed on their top, each of which is braced at one end against the head of a guide screw 21, 22 and at the other end against the respective rocking lever 7, 8. The guide screws 21, 22 extend through the rocking levers 7, 8 into a housing top part 23 which has sharp edges 9, 10 and is connected to the upper rim of the housing 1 by flanges 24 which extend over the rim.

Figure 2:
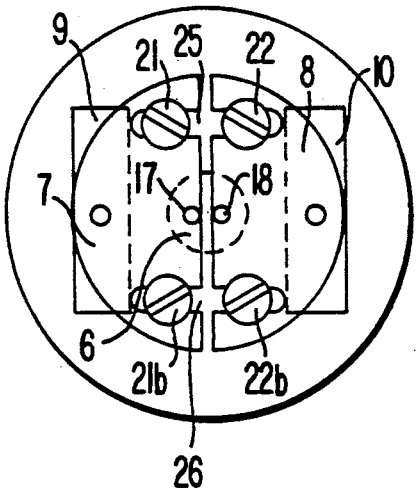
FIG. 2 shows a horizontal section through the switching device along line II—II in FIG. 1.

FIG. 2 makes more clearly evident the design of the switching device in the region of the rocking levers 7, 8. It can be seen that these rocking levers are preferably formed as semispherical half disks and grip partially over the end face of the switch plunger 6. Each rocking lever 7, 8 has two lateral cutouts 25, 26 in the form of a slot which is open toward the straight side of the rocking lever 7, 8 and through each of which a guide screw 21, 21*b* extends. The adjusting screws 17 and 18 are disposed between these guide screws 21, 21*b* and 22, 22*b*. The sharp edges 9, 10 are partially visible in FIG. 2.

Figure 3:
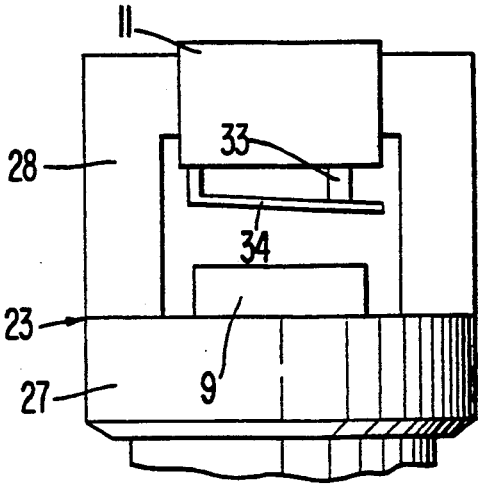
FIG. 3 shows a side elevational view of a housing top part with a microswitch fastened thereto.

FIG. 3 shows that the housing top part 23 consists of a base plate 27 and a support bridge 28. As shown in FIG. 1, there are two holes 29, 30 which run parallel to the main direction of the sharp edges 9, 10, in the horizontal crosspiece of the support bridge 28, and in each of these holes is disposed a displaceable slide piece 31, 32, each of which holds one of the microswitches 11, 12. For the example of microswitch 11, it can be seen in FIG. 3 that it has a switch lever 34 supported on it to actuate its switch pin 33. The rocking lever 7, not shown in FIG. 3, is braced against this switch lever 34. If the microswitch 11 is displaced crosswise relative to the rocking lever by moving slide piece 31 in the hole 29 rightward or leftward as seen in FIG. 3, then the distance from the bracing point of the rocking lever 7 to the fulcrum of the switch lever 34 of the microswitch 11 changes. This changes the transformation ratio between the movement of the rocking lever and the displacement of the switch pin 33, whereby the distance between the switching point and the switchback point can be decreased or increased.

I claim:

1. A pressure operated electrical switching device, comprising:

a housing having two sharp edges formed on a top portion thereof on opposite sides of a longitudinal axis of the housing;

an axially movable switch plunger disposed in said housing along the longitudinal axis;

two opposing rocking levers each rockably arranged on one of said two sharp edges so that an inner end portion of each rocking lever communicates with the axially movable switch plunger; and two microswitches each mounted on the housing so as to be switchable by an outer end portion of one of said rocking levers.

2. A pressure operated electrical switching device as claimed in claim 1, wherein the top portion of the housing comprises a base plate on which the sharp edges are formed and a support bridge having side faces to which the two microswitches are mounted.

3. A pressure operated electrical switching device as claimed in claim 2, wherein each microswitch comprises a switch lever running in a direction parallel to a corresponding one of said two sharp edges, and wherein the microswitches are mounted on the side faces of the support bridge so as to be movable in the direction of the switch lever.

4. A pressure operated electrical switching device as claimed in claim 3, further comprising two slide pieces disposed in two holes in the support bridge, wherein each of said slide pieces holds a corresponding one of said microswitches.

5. A pressure operated electrical switching device as claimed in claim 1, wherein each of the rocking levers is biased toward the switch plunger with a spring, and the bias of the lever is adjustable by adjustment of a guide.

6. A pressure operated electrical switching device as claimed in claim 1, wherein the top portion of the housing is separable from a bottom portion of the housing and is connected thereto by at least one flange formed in the top portion of the housing.

7. A pressure operated electrical switching device as claimed in claim 1, wherein each rocking lever is formed as a semicircular disk so that a straight edge of the semicircular disk communicates with the switch plunger, wherein two cutouts are formed in each semicircular disk through which two guide screws are disposed, and wherein a bias spring is disposed about each guide screw for biasing the rocking lever toward the switch plunger.

8. A pressure operated electrical switching device as claimed in claim 1, further comprising a piston and a stop plate fixed to the housing, wherein an end of the switch plunger opposite the rocking levers comprises a switch extension which extends through a hole in the stop plate and communicates with the piston, and wherein movement of the piston into the hole in the stop plate is limited by a shoulder formed in the hole.

* * * * *